US012392340B2

(12) United States Patent
Blatt

(10) Patent No.: US 12,392,340 B2
(45) Date of Patent: Aug. 19, 2025

(54) SINGLE-ENTRY SCREW PUMP

(71) Applicant: ITT Bornemann GmbH, Obernkirchen (DE)

(72) Inventor: David Johannes Blatt, Obernkirchen (DE)

(73) Assignee: ITT Bornemann GmbH, Obernkirchen (DE)

( * ) Notice: Subject to any disclaimer, the term of this patent is extended or adjusted under 35 U.S.C. 154(b) by 0 days.

(21) Appl. No.: 18/651,519

(22) Filed: Apr. 30, 2024

(65) Prior Publication Data

US 2024/0369058 A1 Nov. 7, 2024

(30) Foreign Application Priority Data

May 3, 2023 (DE) ..... 102023111408.5

(51) Int. Cl.

| | |
|---|---|
| ***F04C 2/16*** | (2006.01) |
| ***F04C 2/08*** | (2006.01) |
| ***F04C 15/00*** | (2006.01) |
| ***F04C 15/06*** | (2006.01) |

(52) U.S. Cl.

CPC ..... *F04C 2/16* (2013.01); *F04C 2/086* (2013.01); *F04C 15/0088* (2013.01); *F04C 15/06* (2013.01); *F04C 2240/30* (2013.01); *F04C 2240/50* (2013.01); *F04C 2240/52* (2013.01); *F04C 2250/10* (2013.01); *F04C 2250/101* (2013.01); *F04C 2250/102* (2013.01)

(58) Field of Classification Search

CPC ..... F04C 2/16; F04C 2/086; F04C 15/0088; F04C 15/06; F04C 2240/30; F04C 2240/50; F04C 2240/52; F04C 2250/10; F04C 2250/101; F04C 2250/102

See application file for complete search history.

(56) References Cited

U.S. PATENT DOCUMENTS

| | | | |
|---|---|---|---|
| 4,212,543 | A | 7/1980 | Bersano |
| 4,744,669 | A | 5/1988 | Kowalczyk et al. |
| 5,083,506 | A | 1/1992 | Horn et al. |
| 5,372,418 | A | 12/1994 | Biesenberger et al. |

(Continued)

FOREIGN PATENT DOCUMENTS

| | | |
|---|---|---|
| AT | 342 423 B | 4/1978 |
| DE | 35 20 994 A1 | 1/1986 |

(Continued)

*Primary Examiner* — Mary A Davis

(74) *Attorney, Agent, or Firm* — Knobbe, Martens, Olson & Bear, LLP

(57) ABSTRACT

A single-entry screw pump with a housing which has an inlet and an outlet for a medium to be pumped, with two spindles which are rotatably mounted in the housing in slide bearings, the spindles each have a screw thread on their outer circumference between the slide bearings, the screw threads of the spindles engage with one another and convey the medium from the inlet to the outlet, the housing has a sleeve section in which the screw threads of the spindles are positioned, the sleeve section has a suction-side inlet opening and a pressure-side outlet opening, wherein the media flow from the inlet to the inlet opening is guided along the pressure-side slide bearing in a hydraulically equalising manner and from the outlet opening to the outlet along the suction-side slide bearing.

20 Claims, 3 Drawing Sheets

(56) References Cited

U.S. PATENT DOCUMENTS

| | | | | |
|---|---|---|---|---|
| 6,186,655 | B1 | 2/2001 | Brookes et al. | |
| 6,298,751 | B1 | 10/2001 | Ide et al. | |
| 6,685,453 | B2 * | 2/2004 | Oehman, Jr. ..... | F04C 15/06 418/206.8 |
| 7,017,732 | B2 | 3/2006 | Uphus | |
| 7,862,315 | B2 | 1/2011 | Rohlfing et al. | |
| 9,630,345 | B2 | 4/2017 | Alsewailem | |
| 10,486,383 | B1 | 11/2019 | Allard et al. | |
| 10,731,082 | B2 | 8/2020 | Tenore et al. | |
| 11,241,026 | B2 | 2/2022 | Wenger et al. | |
| 2005/0219943 | A1 | 10/2005 | Yamane et al. | |
| 2007/0274842 | A1 | 11/2007 | Campen et al. | |
| 2013/0156545 | A1 | 6/2013 | Britsch | |
| 2021/0355938 | A1 | 11/2021 | Trossmann et al. | |

FOREIGN PATENT DOCUMENTS

| | | | |
|---|---|---|---|
| DE | 4416077 | A1 | 11/1995 |
| DE | 19502173 | A1 | 8/1996 |
| DE | 19829195 | A1 | 1/2000 |
| DE | 10162772 | A1 | 7/2003 |
| DE | 10251508 | A1 | 5/2004 |
| DE | 10257859 | A1 | 7/2004 |
| DE | 202004018377 | U1 | 4/2005 |
| DE | 102004030123 | B3 | 10/2005 |
| DE | 202009000690 | U1 | 4/2009 |
| DE | 102007060174 | A1 | 6/2009 |
| DE | 102010038863 | A1 | 2/2012 |
| DE | 202013000913 | U1 | 5/2014 |
| DE | 102016120579 | B3 | 4/2018 |
| DE | 102018130472 | A1 | 6/2020 |
| DE | 102021101111 | A1 | 7/2022 |
| DE | 102021208481 | A1 | 2/2023 |
| EP | 3913187 | A1 | 11/2021 |
| WO | WO 2014/019687 | A2 | 2/2014 |

* cited by examiner

SINGLE-ENTRY SCREW PUMP

CROSS REFERENCE TO RELATED APPLICATION

Any and all applications for which a foreign or domestic priority claim is identified in the Application Data Sheet of the present application are hereby incorporated by reference in their entireties under 37 CFR 1.57. This application claims the priority benefit of German Application No. 10 2023 111 408.5 filed May 3, 2023, the entirety of which is incorporated herein by reference.

BACKGROUND

Technical Field

The present application relates to a single-flow pump, and more particularly, a single-entry screw pump with a housing which has an inlet and an outlet for a medium, within rotatably mounted spindles.

Brief Description of Related Art

Pumps are used across various industries to transport mediums with differing viscosities and compositions. However, pumps often face issues with wear, efficiency under varying pressure conditions, and/or leakage.

SUMMARY

In some aspects, the techniques described herein relate to a single-entry screw pump including: a housing including: an inlet; an outlet; a sleeve section including an inlet opening and an outlet opening; and, two or more spindles, wherein the two or more spindles are rotatably mounted in the housing between a first slide bearing and a second slide bearing, wherein the two or more spindles include screw threads on their outer circumference, wherein the screw threads are positioned within the sleeve section and engage with one another and convey a medium from the inlet to the outlet and along the first slide bearing and the second slide bearing to provide hydraulically equalization.

In some aspects, the techniques described herein relate to a single-entry screw pump, wherein the housing further includes a first bearing section in which the first slide bearing is positioned, and a second bearing section in which the second slide bearing is positioned, wherein the sleeve section is positioned between the first bearing section and the second bearing section.

In some aspects, the techniques described herein relate to a single-entry screw pump, wherein the housing further includes an inlet section that connects to the first bearing section on a side facing away from the sleeve section and an outlet section that connects to the second bearing section on a side facing away from the sleeve section.

In some aspects, the techniques described herein relate to a single-entry screw pump, wherein the inlet section includes an inlet channel, and wherein the outlet section includes an outlet channel.

In some aspects, the techniques described herein relate to a single-entry screw pump, wherein the first slide bearing includes a first bearing gap that opens into the inlet section and the second slide bearing includes a second bearing gap that opens into the outlet section.

In some aspects, the techniques described herein relate to a single-entry screw pump, wherein the housing further includes a feed channel from the inlet to the inlet opening and a discharge channel from the outlet opening to the outlet, wherein both the feed channel and the discharge channel are positioned in the sleeve section outside the two or more spindles.

In some aspects, the techniques described herein relate to a single-entry screw pump, wherein at least one of the bearing sections includes of at least one passage opening.

In some aspects, the techniques described herein relate to a single-entry screw pump, wherein the first slide bearing and second slide bearing are lubricated with the medium.

In some aspects, the techniques described herein relate to a single-entry screw pump, wherein the housing is a modular construction and wherein at least one of the first bearing section, the second bearing section, the sleeve section, the inlet section, and the outlet section are manufactured separately and fixed to one another.

In some aspects, the techniques described herein relate to a single-entry screw pump, wherein at least one spindle of the two or more spindles has a drive section projecting from the housing.

BRIEF DESCRIPTION OF THE DRAWINGS

The drawing includes the following Figures, which are not necessarily drawn to scale.

Figure 1:
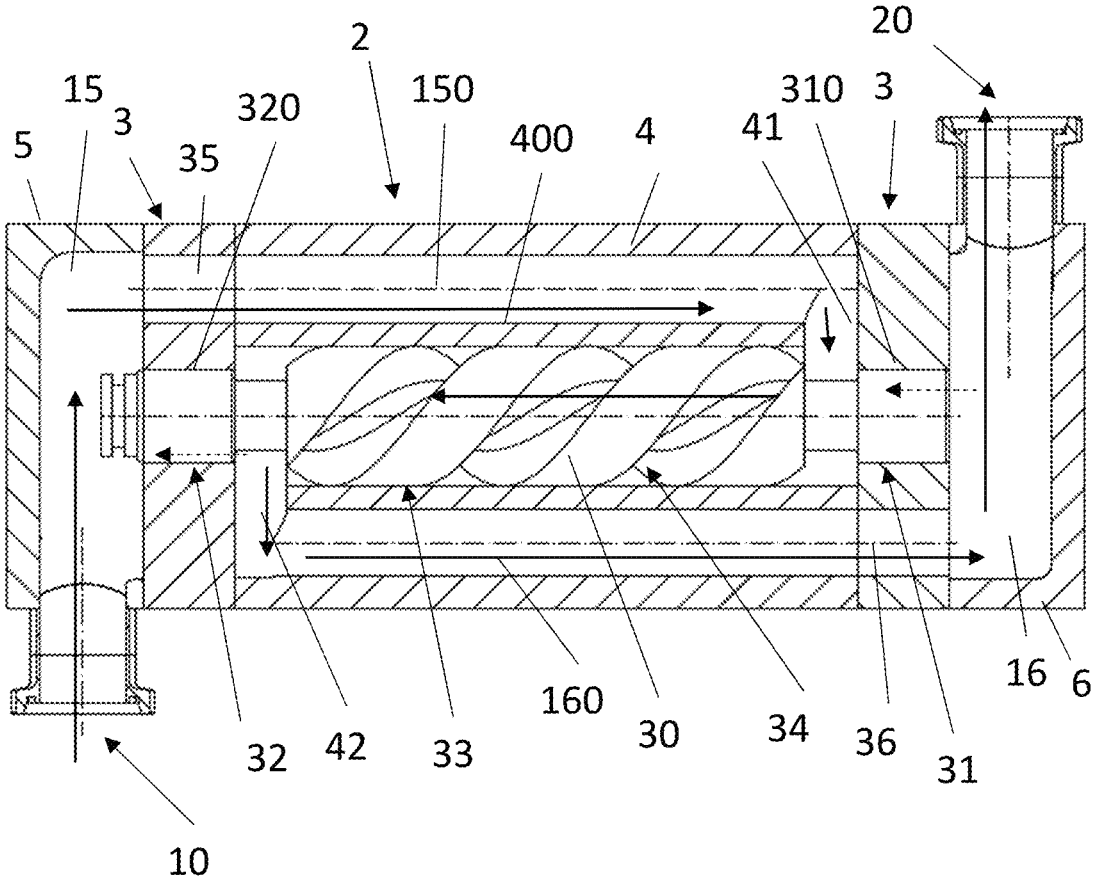
FIG. 1 illustrates a sectional view of a screw pump along I-I of FIG. 4, according to some embodiments.

The drawing includes examples of possible implementations; and the scope of the invention is not intended to be limited to the implementations shown therein. For example, the scope of the invention is intended to include, and embodiments are envisioned using, other implementations besides, or in addition to, that shown in the drawing, which may be configured within the spirit of the underlying invention disclosed in the present application as a whole.

DETAILED DESCRIPTION

The present application relates to a single-entry screw pump with a housing which has an inlet and an outlet for a medium to be pumped, with two spindles which are rotatably mounted in the housing in slide bearings. In some embodiments, the spindles each have a screw thread on their outer circumference between the slide bearings. The screw threads of the spindles may engage with each other and convey the medium from the inlet to the outlet. In some embodiments, the housing has a sleeve section in which the screw threads of the spindles are arranged or located and which may have a suction-side inlet opening and a pressure-side outlet opening.

U.S. Pat. No. 7,862,315B2, which is incorporated by referenced herein, describes a single-entry screw pump with a housing, a bearing housing, and screw shafts.

Screw pumps are rotating positive displacement pumps in which one, two, three or more screw spindles convey a medium within a volume enclosed by a housing from an inlet to an outlet of the housing. In some embodiments, the medium is conveyed in the axial direction of flow. Distinguishing features between screw pumps of different types are, for example, the number of screw spindles used, the thread on the outside of the screw thread of the screw spindles, the bearing, the torque transmission between the screw spindles and the number and direction of the fluid flows. In a twin-spindle screw pump, the medium may be pumped by two counter-rotating spindles with a left-sided and a right-sided external screw thread. In some embodiments, the thread flanks of the two spindles do not touch, instead the thread flanks of one spindle would come into radial grooves between the counter thread flanks of the other spindles and vice versa. The medium to be pumped may be conveyed in the axial direction in gaps between the counter thread flanks of the screw threads.

Single-entry screw pumps with wetted slide bearings may be used as lubricating oil pumps, for example. To reduce the effective axial forces, hydraulic equalisation through separate supply lines may be used.

When pumping media in screw pumps, radial forces may be generated in the area of the screw spindles, which may be transmitted to the bearing blocks via spindles or shafts. The distance between the bearings and the screw threads that form the conveyor unit may be reduced to diminish or minimize any bending behaviour. This results in a short leakage space between the sealing systems on the slide bearing and the bearing housing, which can be disadvantageous with highly viscous media.

In the case of single-entry screw pumps with wetted slide bearings, dead spaces may exist due to the connecting lines for hydraulic equalisation, meaning that such pumps cannot be used for some hygienically demanding applications.

Some embodiments of the present application may advantageously fulfils high hygienic requirements and may be used in various applications in the food industry. This high hygienic requirements may be solved by some of the embodiments of a single-entry screw pump disclosed herein. Advantageous embodiments are disclosed in the claims, the description, and the figures.

In some embodiments, the single-entry screw pump has a housing which has an inlet and an outlet for a medium to be pumped, and has two spindles which are rotatably mounted in the housing in the slide bearings. The spindles may each have a screw thread on their outer circumference between the slide bearings. The screw threads of the spindles may engage with one another and convey the medium from the inlet to the outlet. The housing may have a sleeve section in which the screw threads of the spindles are positioned. In some embodiments, the sleeve section may have a suction-side inlet opening and a pressure-side outlet opening, whereby the medium flow of the medium to be pumped may be hydraulically equalised from the inlet to the inlet opening of the sleeve section at the pressure-side slide bearing and from the outlet opening of the sleeve section to the outlet at the suction-side slide bearing.

In some embodiments, the media-lubricated, single-entry screw pump mounted in slide bearings guides the media flow in such a way that when the screw pump is used, the arrangement of the fluid flow past the slide bearings results in hydraulic equalisation during delivery without the need for separate equalisation lines or supply lines. As a result, the entire media flow may be guided along the slide bearings both on their pressure side and on their suction side. In some embodiments, this makes it possible to provide a pump for the medium to be pumped without dead spaces inside the housing in a compact embodiment and without separate supply lines for hydraulic equalisation.

In some embodiments, the slide bearings may be lubricated with pumped liquid and can be positioned very close to the screw threads of the spindle. Because the spindles may be mounted in slide bearings on both the pressure side and the suction side, the spindles can be guided precisely. Advantageously, deformations due to radial forces may be reduced or minimised. In some embodiments, the suction-side end of a spindle is the end at which the medium to be pumped from the inlet meets the screw thread, the pressure-side end of the spindle is the end at which the medium to be pumped leaves the screw thread. For example, the suction-side end may be at the end at which the conveying movement starts at the screw threads, the pressure-side end may be the end at which conveying ends at the screw threads.

In some embodiments, the housing has two bearing sections in which the slide bearings are positioned and which delimit the end face of the sleeve section. The bearing sections can be manufactured separately and attached to the sleeve section reversibly or irreversibly (e.g., permanently). The slide bearings may be either incorporated into the respective bearing section or inserted into it. By manufacturing the bearing sections separately from the sleeve section, it may be possible to make an optimised choice of material so that the mechanical loads on the slide bearings can be absorbed in the bearing sections as required. Alternatively, or in addition, the sleeve section and at least one bearing section are designed as a single component, with a bearing or bearing mount being arranged or formed in at least one bearing section, which enables the spindles to be mounted. This may advantageously prevent the formation of a parting line.

In some embodiments, the housing has an inlet section and an outlet section that may connect to the bearing sections on the side facing away from the sleeve section. Such an embodiment may result in a structure of the screw pump with a centre sleeve section and two bearing sections adjoining it on the outside and opposite each other, and an inlet section and an outlet section, which in turn adjoin the bearing sections on the outside and form an end face boundary of the housing. The inlet section and the outlet section can may be separate components and attached to the respective bearing section. Alternatively, or in addition, at least one inlet section or outlet section and one bearing section may be one component. This may prevent the formation of a parting line.

In some embodiments, an inlet channel is formed in the inlet section, and in some embodiments, an outlet channel is formed in the outlet section, wherein the inlet channel and the outlet channel are arranged or positioned or formed both in the inlet section and the outlet section in such a way that the latter may be guided along the pressure-side and/or suction-side slide bearings of the spindles. In some embodiments, the inlet channel and the outlet channel are in a fluidic connection with the slide bearings, in particular the slide bearings open directly into the inlet channel or outlet channel, so that hydraulic equalisation is provided in a simple manner together to provide a lubricant supply by the medium that is being conveyed from the inlet to the outlet.

In some embodiments, the pressure-side slide bearing has a bearing gap that opens into the inlet section, in particular into the inlet channel; the suction-side slide bearing may also have a bearing gap that opens into the outlet section, in particular into the outlet channel.

In some embodiments, a feed channel from the inlet to the inlet opening and a discharge channel from the outlet opening to the outlet in the housing are formed in the sleeve section outside the spindles. The feed channel may guide the medium to be pumped against the direction of conveying of the screw spindles from the inlet to the inlet opening in the sleeve section, the discharge channel also guides the medium to be pumped against the direction of conveying of the screw spindles from the outlet opening at the pressure-side end of the spindles through the discharge channel in the sleeve section to the outlet of the screw spindle pump.

In a multi-section embodiment with an inlet section, a bearing section, a sleeve section, a further bearing section and an outlet section, the medium to be pumped may be conveyed from the inlet through the pressure-side bearing section and the sleeve section to the inlet opening against the direction of conveying of the spindles. For example, the medium may be sucked in. In some embodiments, holes or an inner casing surface surrounding the spindles on the outside are arranged or formed within the sleeve section. In these, the medium may be conveyed by the screw spindles within the sleeve section along the longitudinal extension of the spindles into conveying chambers, which may be formed by the inner casing surface and the intermeshing screw threads, and pressed out of the outlet opening. The discharge channel is also designed in such a way that it conveys the medium to be pumped in a direction that is opposite to the direction of conveying of the screw spindles. Within the outlet section, the medium to be pumped may then be conveyed along the slide bearings to the outlet.

In some embodiments, at least one passage opening for the medium is formed in the bearing section, which may be aligned with the feed channel or the discharge channel or opens into it and is in fluidic connection with an inlet channel or outlet channel of the inlet section or the outlet section.

In some embodiments, the housing may be modular and the bearing sections, the sleeve section, the inlet section and the outlet section are manufactured separately and fixed to each other. Alternatively, or in addition, at least two of the sections may be formed together to avoid parting lines.

To drive the spindles, a drive section protruding from the housing may be positioned or formed on at least one end face. To minimise or reduce the effort required for sealing and synchronisation, only one spindle may have a drive section protruding from the housing. To transmit torques, the two spindles can be coupled with synchronising gears so that the drive torque of one drive is transmitted from the drive section to the other spindle. This avoids the need for torque transmission through the screw threads on the spindles. Alternatively, or in addition, the screw threads mesh and transmit forces during the transport of the medium to be pumped via the medium and/or via direct contact.

In the following, exemplary embodiments of the invention are explained in more detail with reference to the figures. Identical reference signs denote similar or identical components or parts. Not all reference signs are shown in all figures in order to ensure clarity.

FIG. 1 shows a horizontal sectional view of an embodiment of the screw pump with a housing 2 that has an inlet 10 and an outlet 20 for a medium to be pumped. The flow of the medium is indicated by the arrows inside the pump. In some embodiments, from the inlet 10, the medium to be pumped flows through an inlet channel 15 through a passage opening 35 of a bearing section 3 into a feed channel 150 of a sleeve section 4. The medium flows from the feed channel 150 through an inlet opening 41 to a conveyor section 400, in which screw spindles 30 with screw thread 34 are mounted. By rotating the spindles 30 with the screw threads 34, the medium may be conveyed from the inlet opening 41 to an outlet opening 42 of the conveyor section 400. In some embodiments, the two screw threads 34 within the conveyor section 400 form conveyor chambers which are bounded on the outside by the inner casing surface. The inner casing surface of the conveyor section 400 surrounds the non-overlapping areas of the screw threads 34 on the outside, so that conveyor chambers are formed by the meshing screw threads 34 of the spindles 30 in conjunction with the inner casing surface of the conveyor section 400, in which the medium to be pumped is conveyed from the inlet opening 41 to the outlet opening 42. A discharge channel 160 may lead from the outlet opening 42 against the direction of conveying of the spindles 30 through a passage opening 36 to an outlet section 6 with an outlet channel 16 and from there to the outlet 20.

In some embodiments, both the inlet section 5 and the outlet section 6 are separate components and are attached to the respective bearing sections 3, either reversibly by means of a screw connection or irreversibly by means of a material-locking connection, for example, by welding. The bearing section 3 can also be permanently attached to the sleeve section 4, in particular with a material bond, and the inlet section 5 and/or the outlet section 6 can be reversibly attached to the respective bearing section 3, e.g. by screwing. In the some embodiments, there are parting lines between the individual sections. The bearing section 3 may be disc-shaped, and parting lines may exist between the bearing section 3 and the inlet section 5 or the outlet section 6 and the sleeve section 4. In some embodiments, the parting lines can also be positioned differently, for example further in the direction of the screw threads 34, so that the inlet opening 41 or the outlet opening 42 is formed towards the screw threads 34 in the bearing housing 3. The parting lines can be position as required. A two-part embodiment with a parting line, for example in the center of the sleeve section 4, may ensure that the pump can be assembled, whereby both halves can be constructed in one piece and in the same way. The bearing section 3 can be part of the sleeve section 4 and/or an inlet section 5 and/or outlet section 6, whereby a mounting opening may be provided for the installation of the spindles 30. It is also possible for the respective bearing section 3 to be formed in one piece with the inlet section 5 or the outlet section 6, for example using a primary molding process or an additive manufacturing process. In some embodiments, the slide bearings 31, 32 for the spindles 30 are formed or positioned within the bearing sections 3. The slide bearings 31, 32 can be provided with bearing shells or formed directly in the bearing section 3. The spindles 30 may have correspondingly shaped shoulders or end sections in the area of the slide bearings 31, 32, which may enable rotation within the slide bearings 31, 32. In some embodiments, a respective bearing gap 310, 320 is formed between the spindle heels and the slide bearings 31, 32, in which a medium is located, so that a hydrodynamic slide bearing is formed during use. The lubricating film may be formed by the medium to be pumped. The surfaces of the slide bearings 31, 32 and the spindle heels can be designed or coated in such a way that solid-state friction is reduced or minimized.

The housing 2 may have the central sleeve section 4, in which both the feed channel 150 and the discharge channel 160 are formed. In some embodiments, the conveyor section 400 is formed within the sleeve section 4, which may be incorporated, for example, by corresponding bores with an internal diameter that essentially corresponds to the external diameter of the corresponding spindle 30 in the area of the screw threads 34. The spindles 30 may each have a screw thread 34 on their outer circumference 33, whereby a minimum gap can arise between the outer circumference 33 and the inner diameter of the bores of the conveyor section 400 or the inner casing surface of the conveyor section 400 in order to avoid solid-state friction between the spindles 30 and the casing surface of the conveyor section 400.

As shown in FIG. 1, the sleeve section 4 may have open end faces that are closed by the adjacent bearing sections 3. In some embodiments, the bearing sections 3 are covered by the inlet section 5 and the outlet section 6 on the outer sides opposite the sleeve section 4. The sectional view shows that the aspirated medium is guided through the inlet 10 in the inlet channel 15 along the pressure-side slide bearing 32 and the bearing gap 320. The medium to be pumped, which may be conveyed in the conveyor section 400 in the direction of the outlet opening 42, may have a greater pressure than the medium that is drawn in through the inlet 10 in the inlet channel 15 and fed to the spindles 30 through the feed channel 150. In some embodiments, hydraulic equalization takes place through the bearing gap 320 in the pressure-side slide bearing, which is indicated by the dashed arrow. Similarly, hydraulic equalization may take place between the increased pressure at the outlet channel 16 and the comparatively low pressure, which corresponds to the pressure at the inlet 10, at the inlet opening 41, which is also indicated by the dashed arrow. In some embodiments, the suction-side slide bearing 31 enables hydraulic equalization between a high-pressure side on the outlet channel 16 and a low-pressure side on the inlet port 41. Both slide bearings 31, 32 may be thus lubricated by the pumped medium and there may be generally the same pressure difference between a high-pressure side and a low-pressure side at both slide bearings 31, 32.

In some embodiments, the entire conveyed medium passes through the housing 2 without forming dead spaces. Before the medium to be conveyed enters the conveyor section 400 and before it comes into contact with the screw spindles 30, the medium may be fed to the screw spindles 30 in the opposite direction to the direction of conveying. After leaving the screw spindles 30, the medium to be pumped is discharged with increased pressure in the discharge channel 160 in the same direction as in the feed channel 150 against the direction of conveying of the screw spindles 30. In some embodiments, both the feed channel 150 and the discharge channel 160 can be formed as holes within the sleeve section 4. Alternatively, the channels may have been incorporated during the original molding of the sleeve section 4, for example during casting.

Figure 2:
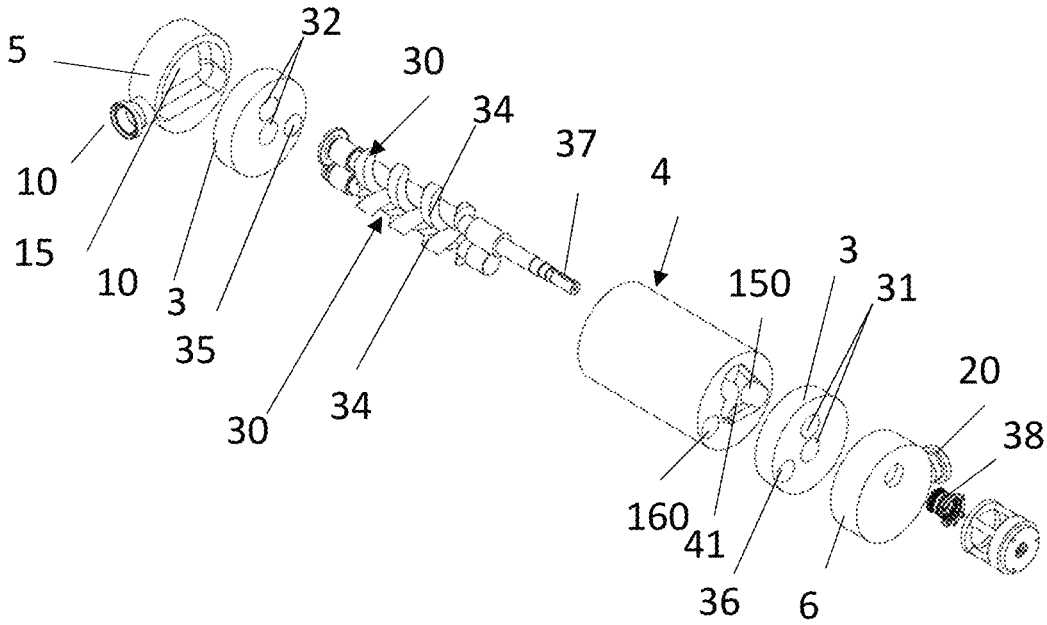
FIG. 2 illustrates an exploded view of the screw pump of FIG. 4, according to some embodiments.

FIG. 2 shows an exploded view of an embodiment of the screw pump in perspective. In some embodiments, the inlet section 5 with the inlet 10 and the inlet channel 15 forms the front end, which may be adjoined by a bearing section 3 with the two pressure-side slide bearings 32 and the passage opening 35 for the medium to be pumped. The two screw spindles 30, each with a screw thread 34 positioned or formed on it, may be in engagement with each other and may be orientated parallel to each other. In some embodiments, spindle sections for mounting in the slide bearings 32 are formed at the pressure-side end of the screw spindles 30. On the end face of the spindles 30, which may protrude beyond the pressure-side slide bearings 32, securing elements may be positioned to prevent axial displacement due to the engaging screw threads 34, which will be explained later. In some embodiments, the spindles 30 are inserted into the slide bearings 32 and the sleeve section 4 with the holes for the spindles 30, which are not shown. The feed channel 150 and the discharge channel 160 are illustrated at the right-hand end of the sleeve section 4. Also illustrated in the sleeve section 4 at the right-hand end is the inlet opening 41 as a connection from the feed channel 150 to the spindles 30 or the holes within the conveyor section 400 for the spindles 30.

In some embodiments, the second bearing section 3 with the suction-side slide bearings 31 and the passage opening 36 to the outlet section 6 may correspond to the bearing section 3 with the pressure-side slide bearings 32. The outlet section 6 may have generally the same structure as the inlet section 5. Like the inlet 10, the outlet 20 may be a nozzle or nozzle-like. In contrast to the inlet section 5, the outlet section 6 may also have a passage opening for a drive section 37 of one of the spindles 30 with a seal 38. The seal 38 may prevent the medium to be pumped from escaping from the housing 2 at a point where it should not (e.g., prevent leakage).

Figure 3:
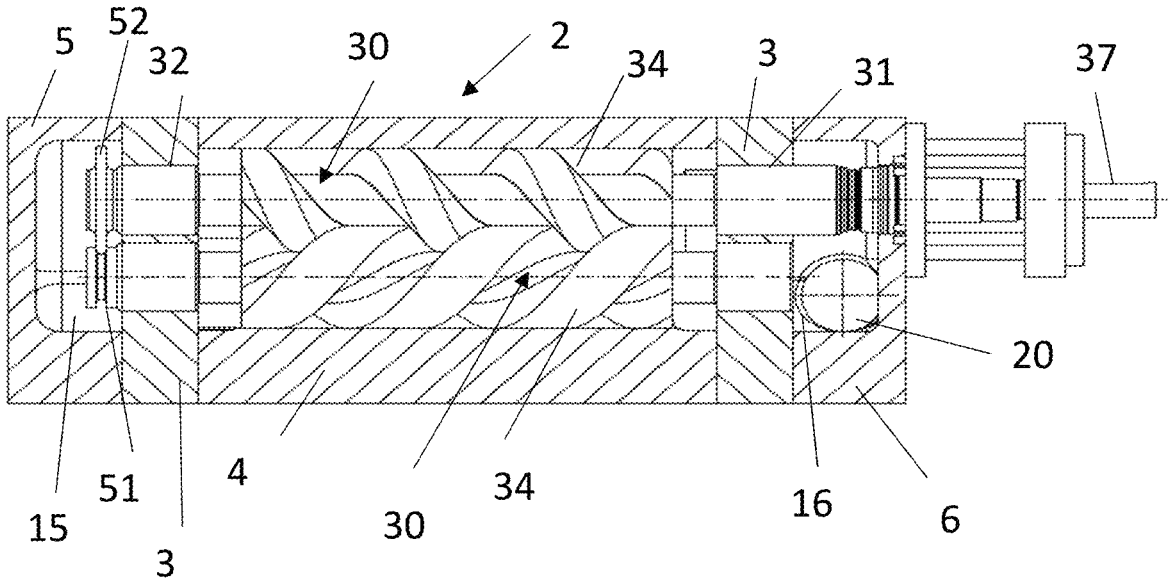
FIG. 3 illustrates a vertical section view of the screw pump along III-III of FIG. 4, according to some embodiments.

FIG. 3 shows an embodiment of the assembled screw pump as a single-entry screw pump in a vertical section looking from the inlet 10. FIG. 3 illustrates the one-piece structure of the inlet section 5 as well as the bearing sections 3 and the sleeve section 4. In some embodiments, within the inlet channel 15 at the inlet section 5, securing elements 51, 52 are formed as a circumferential groove and a round disc positioned therein, each of which is attached to a spindle 30. The securing elements 51, 52 may absorb any axial forces that occur due to the conveying movement and ensure that the screw threads 34 of the spindles 30 do not jam. in some embodiments, synchronization gears may no longer be necessary. FIG. 3 also shows that the upper spindle 30 has a shaft section beyond the suction-side slide bearing 31 in the form of a drive section 37, which projects through the outlet section 6 and is sealed by a seal 38, for example a mechanical seal. In some embodiments, a motorized drive can then be arranged or coupled to the drive section 37, either via a direct coupling or, for example, a gear wheel.

Figure 4:
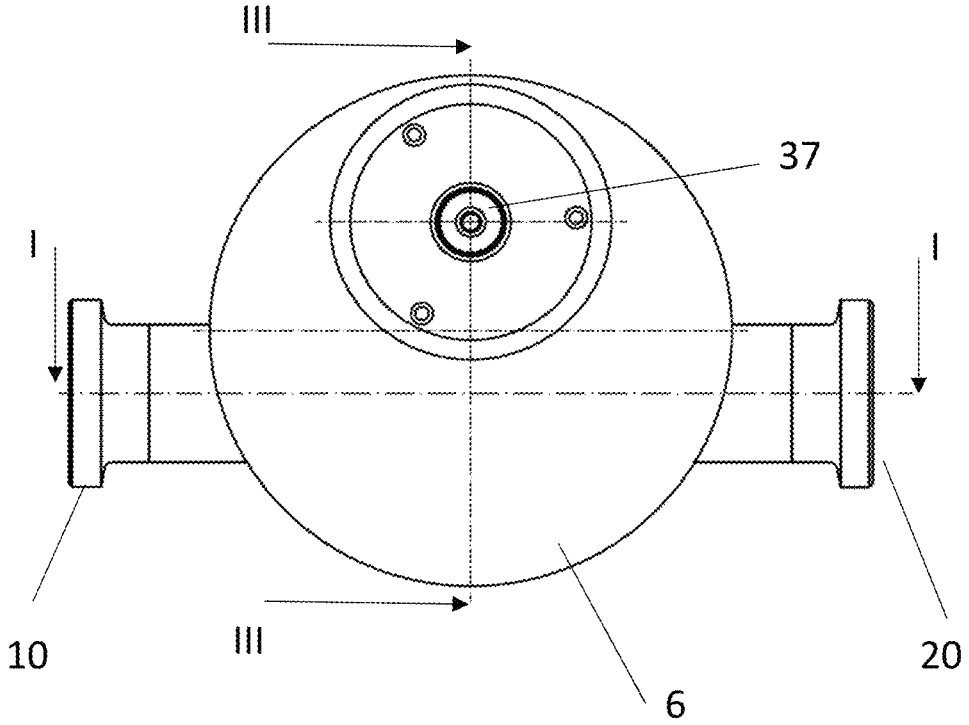
FIG. 4 illustrates a front view of the drive side of the screw pump, according to some embodiments.

FIG. 4 shows a front view looking towards the drive section 37 and the outlet section 6 of an embodiment. Inlet 10 and outlet 20 may be generally the same height. In some embodiments, the entire housing 2 is essentially cylindrical, apart from the nozzles for the inlet 10 and the outlet 20, so that a compact embodiment can be achieved.

Figure 5:
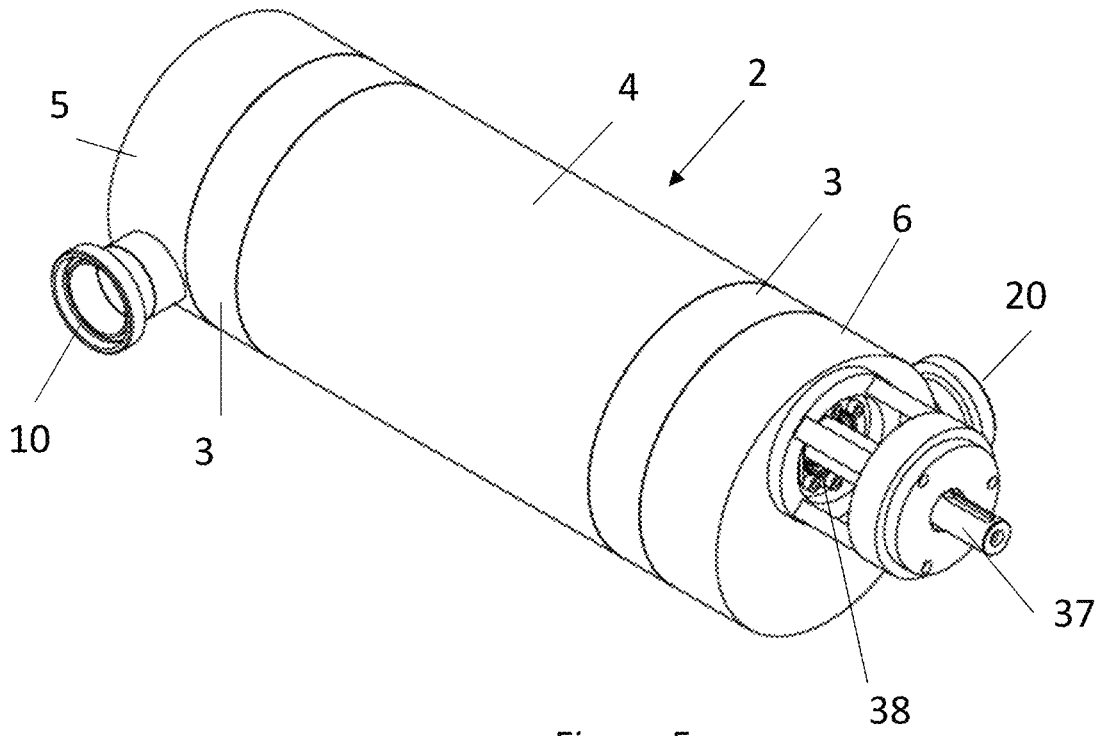
FIG. 5 illustrates a perspective view of the screw pump of FIG. 4, according to some embodiments.

FIG. 5 shows a perspective view of an embodiment of the single-entry screw pump in its assembled state. FIG. 5 illustrates the structure with a central sleeve section 4, the bearing sections 3 adjoining it on both sides on the outside and the inlet section 5 or outlet section 6 on the outside at the end face. FIG. 5 also illustrates the protruding drive section 37 of a spindle 30 with the seal 38 inside the outlet section 6.

Figure 6:
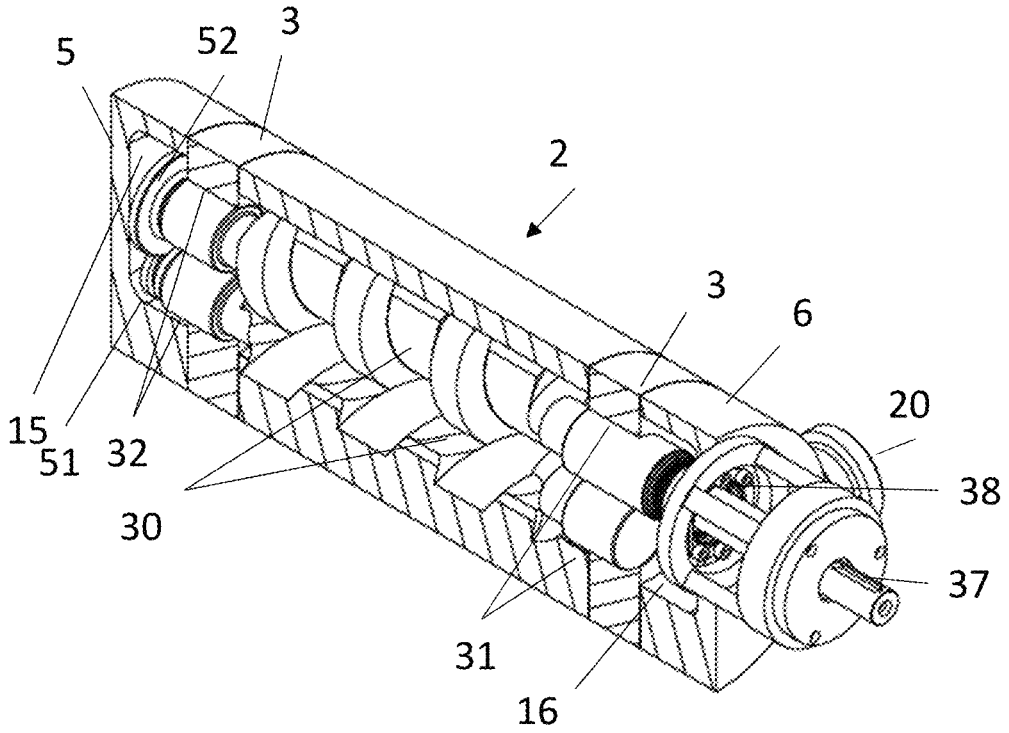
FIG. 6 illustrates a perspective of a vertical section of the screw pump of FIG. 4, according to some embodiments.

FIG. 6 shows a partial perspective section of an embodiment of the screw pump. FIG. 6 illustrates the securing elements 51, 52 and the pressure-side slide bearings 32 that may be in fluidic connection with the medium to be conveyed via the inlet channel 15. In some embodiments, the medium conveyed by the spindles 30 is pressed against the pressure-side slide bearings 32; hydraulic equalization with the inlet side may then take place through the bearing gap of the slide bearings 32, which is not shown. The same may take place on the side of the outlet channel 16 with the inlet-side slide bearings 31.

What is claimed:

1. A single-entry screw pump comprising:

a housing comprising:

an inlet;

an outlet; and a sleeve section comprising an inlet opening and an outlet opening; and two or more spindles, wherein the two or more spindles are rotatably mounted in the housing between a first slide bearing and a second slide bearing, wherein the two or more spindles comprise screw threads on their outer circumference, wherein the screw threads are positioned within the sleeve section and engage with one another and convey a medium from the inlet to the outlet and along the first slide bearing and the second slide bearing to provide hydraulic equalization, wherein an end face of the first slide bearing is proximate to the inlet and an opposite end face of the first slide bearing is proximate to the outlet opening.

2. The single-entry screw pump of claim 1, wherein the housing further comprises a first bearing section in which the first slide bearing is positioned, and a second bearing section in which the second slide bearing is positioned, wherein the sleeve section is positioned between the first bearing section and the second bearing section.

3. The single-entry screw pump of claim 2, wherein the housing further comprises an inlet section that connects to the first bearing section on a side facing away from the sleeve section and an outlet section that connects to the second bearing section on a side facing away from the sleeve section.

4. The single-entry screw pump of claim 3, wherein the inlet section comprises an inlet channel, and wherein the outlet section comprises an outlet channel.

5. The single-entry screw pump of claim 3, wherein the first slide bearing comprises a first bearing gap that opens into the inlet section and the second slide bearing comprises a second bearing gap that opens into the outlet section.

6. The single-entry screw pump of claim 2, wherein at least one of the first bearing section and the second bearing section comprises of at least one passage opening.

7. The single-entry screw pump of claim 1, wherein the housing further comprises a feed channel from the inlet to the inlet opening and a discharge channel from the outlet opening to the outlet, wherein both the feed channel and the discharge channel are positioned in the sleeve section outside the two or more spindles.

8. The single-entry screw pump of claim 7, wherein an end face of the second slide bearing is in fluid communication with the feed channel and an opposite end face of the second slide bearing is in fluid communication with the discharge channel.

9. The single-entry screw pump of claim 1, wherein the first slide bearing and second slide bearing are lubricated with the medium.

10. The single-entry screw pump of claim 1, wherein at least one spindle of the two or more spindles has a drive section projecting from the housing.

11. A single-entry screw pump comprising:

a housing comprising:

an inlet;

an outlet; and a sleeve section comprising an inlet opening and an outlet opening; and two or more spindles, wherein the two or more spindles are rotatably mounted in the housing between a first slide bearing and a second slide bearing, wherein the two or more spindles comprise screw threads on their outer circumference, wherein the screw threads are positioned within the sleeve section and engage with one another and convey a medium from the inlet to the outlet and along the first slide bearing and the second slide bearing to provide hydraulic equalization, wherein an end face of the second slide bearing is proximate to the inlet opening and an opposite end face of the second slide bearing is proximate to the outlet.

12. The single-entry screw pump of claim 11, wherein an end face of the first slide bearing is proximate to the inlet and an opposite end face of the first slide bearing is proximate to the outlet opening.

13. The single-entry screw pump of claim 11, wherein the housing further comprises a first bearing section in which the first slide bearing is positioned, and a second bearing section in which the second slide bearing is positioned, wherein the sleeve section is positioned between the first bearing section and the second bearing section.

14. The single-entry screw pump of claim 13, wherein the housing further comprises an inlet section that connects to the first bearing section on a side facing away from the sleeve section and an outlet section that connects to the second bearing section on a side facing away from the sleeve section.

15. The single-entry screw pump of claim 14, wherein the inlet section comprises an inlet channel, and wherein the outlet section comprises an outlet channel.

16. The single-entry screw pump of claim 14, wherein the first slide bearing comprises a first bearing gap that opens into the inlet section and the second slide bearing comprises a second bearing gap that opens into the outlet section.

17. The single-entry screw pump of claim 14, wherein the housing is a modular construction and wherein at least one of the first bearing section, the second bearing section, the sleeve section, the inlet section, and the outlet section are manufactured separately and fixed to one another.

18. The single-entry screw pump of claim 13, wherein at least one of the first bearing section and the second bearing section comprises of at least one passage opening.

19. The single-entry screw pump of claim 11, wherein the housing further comprises a feed channel from the inlet to the inlet opening and a discharge channel from the outlet opening to the outlet, wherein both the feed channel and the discharge channel are positioned in the sleeve section outside the two or more spindles.

20. The single-entry screw pump of claim 11, wherein the first slide bearing and second slide bearing are lubricated with the medium.

* * * * *